US005847640A

United States Patent [19]

Fukaya et al.

[11] Patent Number: 5,847,640

[45] Date of Patent: Dec. 8, 1998

[54] VARIABLE RESISTOR

[75] Inventors: Kiyohiro Fukaya, Takahama; Yukihiro Kato, Chiryu; Kouji Akashi, Gamagori; Akikazu Matsumoto, Tokoname; Yukihisa Oda, Chiryu, all of Japan

[73] Assignee: Aisin Seiki Kabushiki Kaisha, Kariya, Japan

[21] Appl. No.: 536,430

[22] Filed: Sep. 29, 1995

[30] Foreign Application Priority Data

Sep. 30, 1994 [JP] Japan ..... 6-236650
Sep. 26, 1995 [JP] Japan ..... 7-247796

[51] Int. Cl.[6] ..... H01C 10/30

[52] U.S. Cl. ..... 338/160; 338/162; 338/176; 338/322

[58] Field of Search ..... 338/118, 160, 338/162, 163, 167, 170, 175, 184, 190, 199, 276, 312, 322, 324, 325, 176; 174/52.3, 52.2

[56] References Cited

U.S. PATENT DOCUMENTS

| | | | |
|---|---|---|---|
| 2,141,907 | 12/1938 | Hathorn | 174/59 |
| 2,497,439 | 2/1950 | Cerf | 338/28 |
| 2,804,581 | 8/1957 | Lichtgarn | 174/52.3 |
| 2,958,839 | 11/1960 | Barden | 338/174 |
| 3,085,218 | 4/1963 | Dash | 338/163 |
| 3,091,656 | 5/1963 | Lamoureaux, Jr. | 174/52.2 |
| 3,377,606 | 4/1968 | Ferrell | 338/174 |
| 3,484,734 | 12/1969 | Casey et al. | 338/162 |
| 4,356,344 | 10/1982 | Carey | 174/52.2 |
| 4,429,297 | 1/1984 | Nakatsu | 338/162 |
| 4,454,398 | 6/1984 | Aschenbach et al. | 174/52.2 |
| 4,812,803 | 3/1989 | Hochholzer | 338/175 |
| 4,935,718 | 6/1990 | Yagi et al. | 338/162 |
| 5,039,975 | 8/1991 | Ishihara | 338/312 |
| 5,263,880 | 11/1993 | Scwarz et al. | 174/52.2 |
| 5,469,125 | 11/1995 | Shigemoto et al. | 338/162 |
| 5,525,956 | 6/1996 | Hashizume et al. | 338/162 |
| 5,592,141 | 1/1997 | Aldave | 338/162 |

FOREIGN PATENT DOCUMENTS

| | | |
|---|---|---|
| 453523 | 6/1987 | Japan . |
| 53-9321 | 4/1988 | Japan . |

*Primary Examiner*—Teresa J. Walberg
*Assistant Examiner*—Karl Easthom
*Attorney, Agent, or Firm*—Sughrue, Mion, Zinn, Macpeak & Seas, PLLC

[57] ABSTRACT

A variable resistor includes a first housing, a second housing formed of resin and having a connector part and a circuit board whose surface has an electrode and a resistance pattern thereon. A metallic terminal is molded in the second housing as one body and a brush is mounted on a moving member and is disposed in sliding engagement with the resistance pattern. An end of the terminal is in contact with the electrode on the surface of the circuit board and the other end of the terminal is disposed in the connector part.

5 Claims, 5 Drawing Sheets

VARIABLE RESISTOR

BACKGROUND OF THE INVENTION

The present invention relates to a variable resistor, and in particular to a variable resistor to be used for a vehicle or other type of electric device.

A conventional variable resistor is disclosed in JITUK-OUSHOU (Japanese Utility Model Patent) 4-53523 and is shown in FIG. 13. The variable resistor 40 has a housing 41, a circuit board 42 having printed resistance patterns and electrodes of conductive material thereon is disposed in the housing 41, metallic terminals 43 extending from the inside to the outside of the housing 41, metallic plates 44 connected between the electrodes and the metallic terminals 43 by soldering, a rotating member 48 which is rotatable within the housing 41, and brushes 45 which slide on the resistance patterns in accordance with rotation of the rotating member 48. When the rotating member 48 is rotated, the resistance value between the metallic terminals 43 is varied by the movement of the brushes 45 on the resistance patterns. The circuit board 42 is made from a thermosetting resin such as a glass-epoxy resin.

The circuit board 42 is pressed into the housing 41 by a cover 46 via a packing 47 so as to hold the circuit board 42 in place.

In producing the conventional variable resistor, the metallic plates 44 are soldered to the electrodes of the circuit board 42 by using a flux which is washed by an organic solvent after soldering.

SUMMARY OF THE INVENTION

It is, therefore, a primary object of the present invention to provide a variable resistor which has a reduced number of parts.

It is a further object of the present invention to provide a variable resistor which eliminates the soldering and washing steps.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DESCRIPTION OF THE PREFERRED EMBODIMENTS

Embodiments of the present invention will be described hereinafter in detail with reference to the accompanying drawings.

FIRST EMBODIMENT

Figure 1:
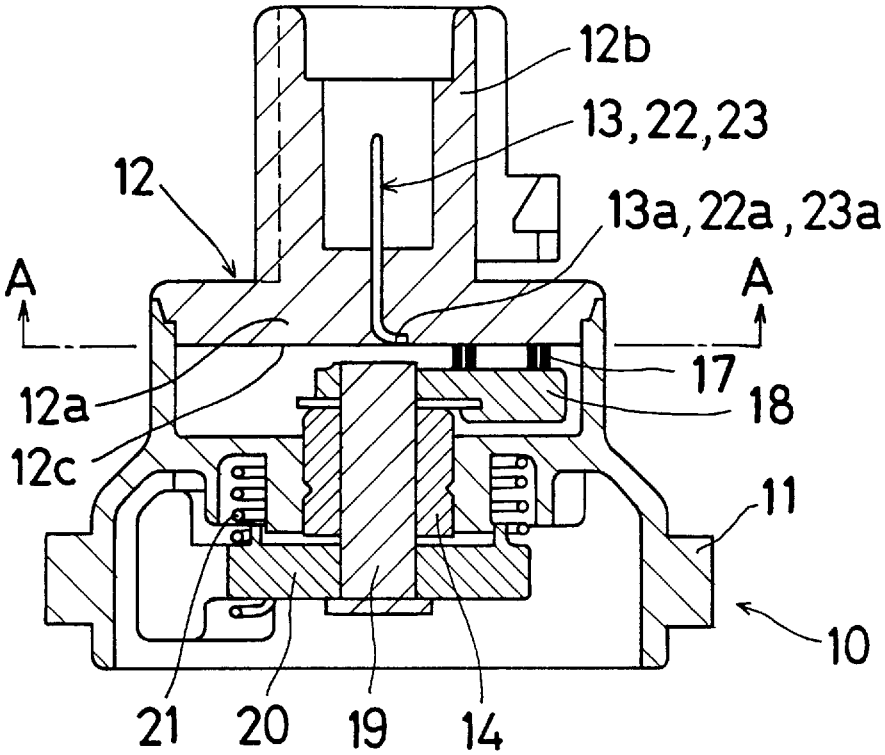
FIG. 1 is a partial cross-sectional view of a variable resistor of a first embodiment according to the present invention.
Figure 2:
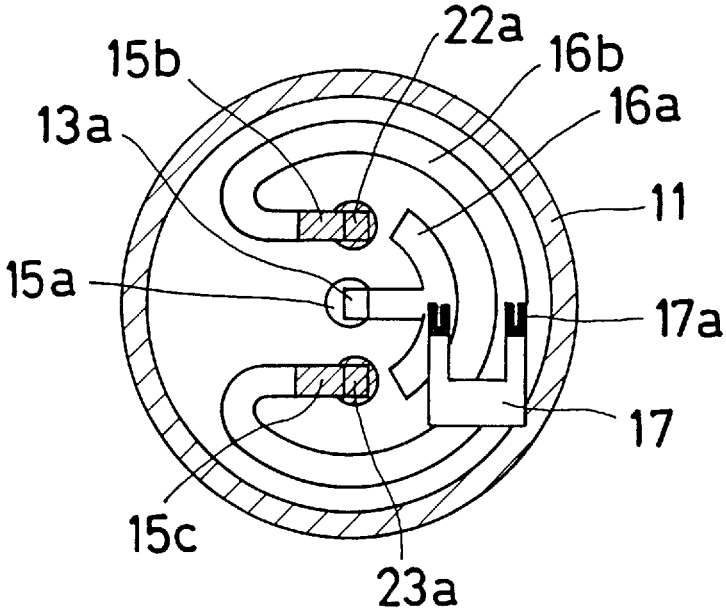
FIG. 2 is a cross-sectional view taken on line A—A of FIG. 1.
Figure 3:
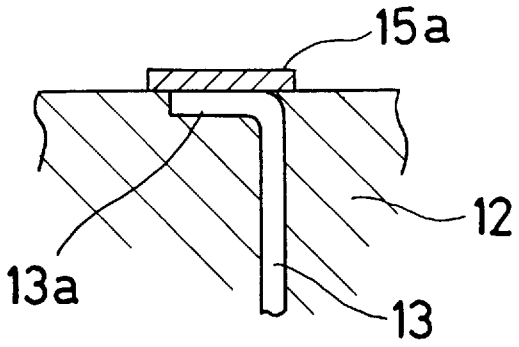
FIG. 3 is a detailed cross-sectional view of FIG. 1.

A first embodiment of a variable resistor according to the present invention is shown in FIGS. 1 to 3. The first embodiment shows a rotary sensor 10 having cylindrical first housing 11, a second housing 12, three metallic terminals 13, 22 and 23, an axle 19 rotatably held in the first housing 11 by a bearing 14, a first rotatable member 20 fixed to the axle 19, a second rotatable member 18 fixed to the axle 19, a brush 17 fixed on the second rotatable member 18, and a coil spring 21.

The second housing 12 is fixed to the first housing 11. The second housing 12 has a circuit board 12*a* and connector part 12*b* in one body. The circuit board 12*a* has a planar surface 12*c*. The three metallic terminals 13, 22 and 23 are molded in the second housing 12. Three ends 13*a*, 22*a* and 23*a* of the metallic terminals 13, 22 and 23 are exposed on the surface of the plane 12*c*. Two circuit patterns are formed on the surface 12*c* of the circuit board 12*a*. The first pattern is made by a conductor 16*a* and an electrode 15*a*. The second pattern is made by a resistance 16*b* and two electrodes 15*b* and 15*c* which are connected at each end of the resistance 16*a*. The three ends 13*a*, 22*a* and 23*a* of the metallic terminals 13, 22 and 23 are electrically connected with the three electrodes 15*a*, 15*b* and 15*c*, respectively. The metallic terminals 13, 22 and 23 extend outside the connector part 12*b*, so as to form a connector.

The coil spring 21 presses the first rotatable member 20 against the first housing 11 toward a rotary direction. The first and second rotatable members 20 and 18 are rotatable with the axle 19. The brush 17 carried by member 18 extends between the conductor 16*a* and the resistance 16*b* and slides thereon.

In this rotary sensor 10, when a voltage is supplied between the terminal 22 and the terminal 23, the voltage of one end 17*a* of the brush 17 is determined in accordance with movement of the brush 17. The terminal 13 is electrically connected with the other end of the brush 17, so that the voltage of the terminal 13 is varied in accordance with rotation of the first rotatable member 20.

In producing the second housing 12, the second housing 12 is first formed by a resin with the terminals 13, 22 and 23 therein as one body. Then a resistance and a conductor are printed on the plane surface 12*c*. The resistance and the conductor are made from a thermosetting resin. Finally, the second housing 12 is heated so that the resistance and the conductor are hardened.

The first and second housings 11 and 12 are secured together by welding, crimping, screwing, or the like.

In the first embodiment of the variable resistor, the terminals 13, 22 and 23 are easy to make by bending a plate.

SECOND EMBODIMENT

Figure 4:
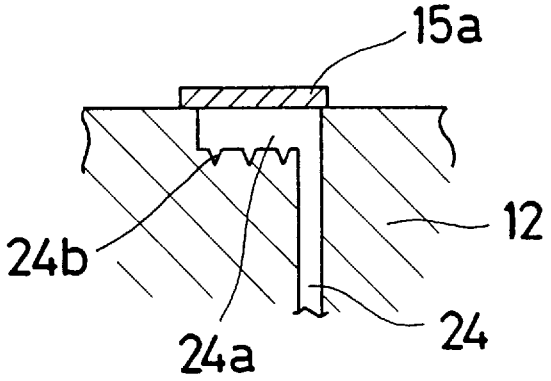
FIG. 4 is a detailed partial cross-sectional view of a variable resistor of a second embodiment according to the present invention.

A second embodiment of a variable resistor according to the present invention is shown in FIG. 4. This second embodiment is different only in the form of the three metallic terminals.

One end 24*a* of a terminal 24 of the second embodiment has wedges 24*b*. The wedges 24*b* extend into the circuit board 12. Whenever the thermal coefficient of expansion of the second housing 12 differs from the terminal 24, it is difficult to cause spacing between the second housing 12 and the terminal 24 due to the wedges 24*b* during heating. Therefor, the electrode 15*a* is less apt to break.

THIRD EMBODIMENT

Figure 5:
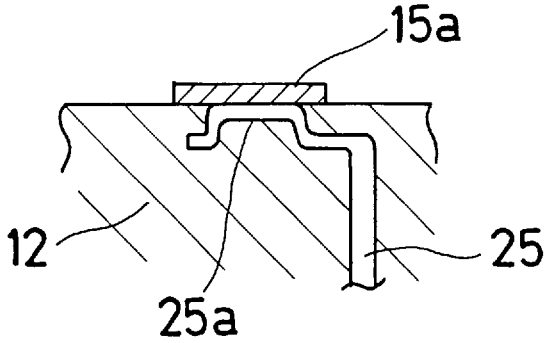
FIG. 5 is a detailed partial cross-sectional view of a variable resistor of a third embodiment according to the present invention.

A third embodiment of a variable resistor according to the present invention is shown in FIG. 5. This third embodiment is different only in the form of the three metallic terminals.

One end 25*a* of a terminal 25 of the third embodiment is made by bending a plate so that the end 25*a* is formed unevenly. The terminal 25 is secured in the second housing 12 by molding in resin as one body. In this way, the resin flows about the uneven form of the end 25*a* so that the terminal 25 is solidly fixed to the second housing 12. Whenever the thermal coefficient of expansion of the second housing 12 differs from that of the terminal 25, it is difficult to cause spacing between the second housing 12 and the terminal 25 during heating. Therefor, the electrode 15*a* is less apt to break.

FOURTH EMBODIMENT

Figure 6:
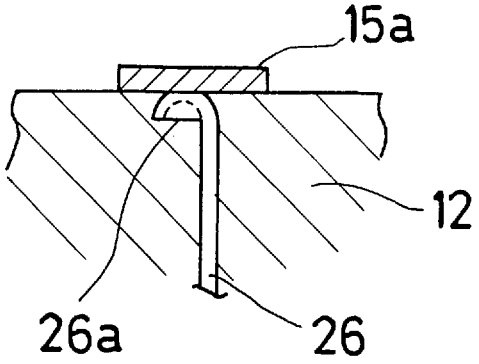
FIG. 6 is a detailed partial cross-sectional view of a variable resistor of a fourth embodiment according to the present invention.

A fourth embodiment of a variable resistor according to the present invention is shown in FIG. 6. This fourth embodiment is different only in the form of the three metallic terminals.

One end 26*a* of a terminal 26 of the fourth embodiment is made by pressing a plate so that the end 26*a* is formed in a hollow spheroid shape. The terminal 26 is secured in the second housing 12 by molding in resin as one body. In this way, the resin flows into the hollow spheroid shape of the end 26*a* so that the terminal 26 is solidly fixed to the second housing 12. Whenever the thermal coefficient of expansion of the second housing 12 differs from that of the terminal 26, it is difficult to cause spacing between the second housing 12 and the terminal 26 during heating. Therefor, the electrode 15*a* is less apt to break.

FIFTH EMBODIMENT

Figure 7:
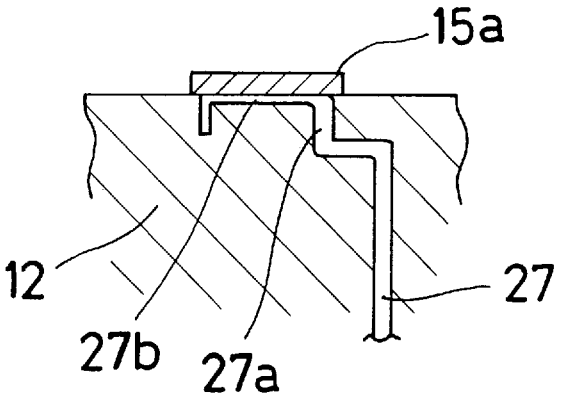
FIG. 7 is a detailed partial cross-sectional view of a variable resistor of a fifth embodiment according to the present invention.

A fifth embodiment of a variable resistor according to the present invention is shown in FIG. 7. This fifth embodiment is different only in the form of the three metallic terminals.

One end 27 of a terminal 27 of the fifth embodiment is made by pressing and bending a plate so that the end 27*a* is formed unevenly with a thin part 27*b*. The terminal 27 is secured in the second housing 12 by molding in resin as one body. In this way, the resin flows about the uneven form of the end 27*a* so that the terminal 27 is solidly fixed to the second housing 12. Whenever the thermal coefficient of expansion of the second housing 12 differs from that of the terminal 27, it is difficult to cause spacing between the second housing 12 and the terminal 27 during heating. Further, because the thin part 27*b* is in contact with the electrode 15*a*, the pressure from the terminal 27 on the electrode 15*a* is small. Therefor, the electrode 15*a* is less apt to break.

SIXTH EMBODIMENT

Figure 8:
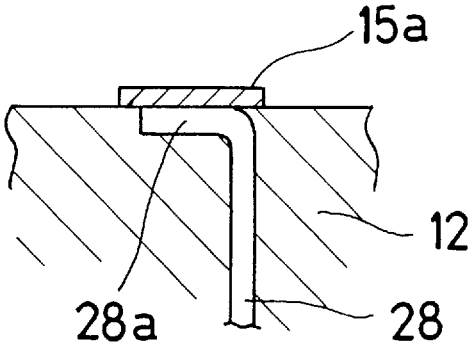
FIG. 8 is a detailed cross-sectional view of a variable resistor of a sixth embodiment according to the present invention.
Figure 9:
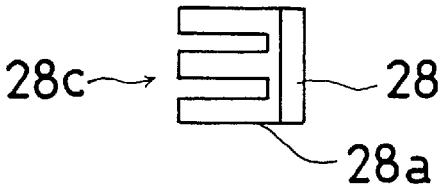
FIG. 9 is a plan view of the metallic terminal of FIG. 8.

A sixth embodiment of a variable resistor according to the present invention is shown if FIGS. 8 and 9. This sixth embodiment is different only in the form of the three metallic terminals of first embodiment.

One end 28*a* of a terminal 28 of the sixth embodiment is made by pressing and bending a plate so that the end 28*a* is formed as a comb 28*c*. The terminal 28 is secured in the second housing 12 by molding in resin as one body. In this way, the resin flows about the teeth of the comb 28*c* so that the terminal 28 is solidly fixed in the second housing 12. Whenever the thermal coefficient of expansion of the second housing 12 differs from that of the terminal 28, it is difficult to cause spacing between the second housing 12 and the terminal 28 during heating. Therefor, the electrode 15*a* is less apt to break.

SEVENTH EMBODIMENT

Figure 10:
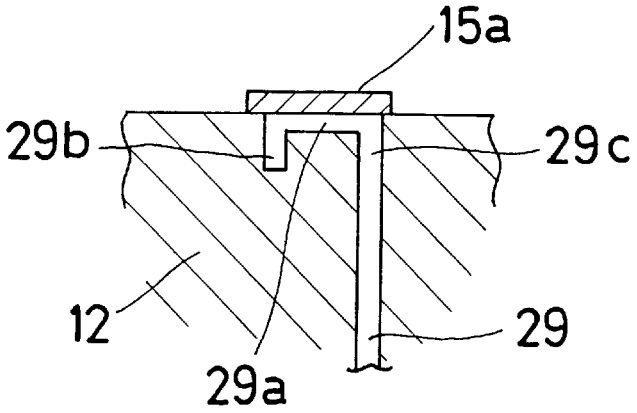
FIG. 10 is a detailed cross-sectional view of a variable resistor of a seventh embodiment according to the present invention.

A seventh embodiment of a variable resistor according to the present invention is shown in FIG. 10. This seventh embodiment is different only in the form of the three metallic terminals of first embodiment.

One end 29*a* of a terminal 29 of the seventh embodiment is made by bending a plate at two points so that the end 29*a* has a reversely turned edge 29*b*. The terminal 29 is secured in the second housing 12 by molding in resin as one body. In this way, the resin flows about the end and the edge 29*b* and straight part 29*c* of the terminal 29 so that the terminal 29 is solidly fixed to the second housing 12. Whenever the thermal coefficient of expansion of the second housing 12 differs from that of the terminal 29, it is difficult to cause spacing between the second housing 12 and the terminal 29 during heating. Therefor, the electrode 15*a* is less apt to break.

EIGHTH EMBODIMENT

Figure 11:
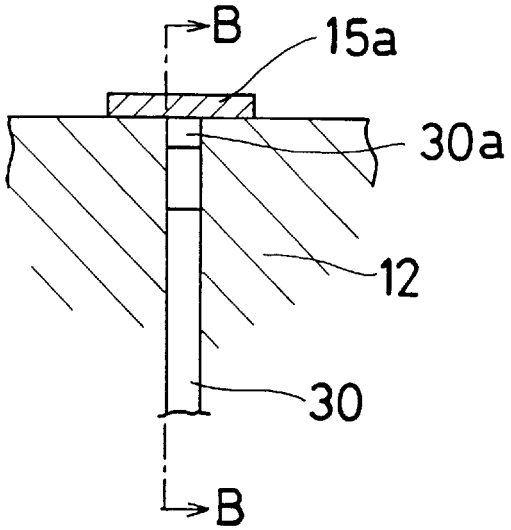
FIG. 11 is a detailed partial cross-sectional view of a variable resistor of an eighth embodiment according to the present invention.
Figure 12:
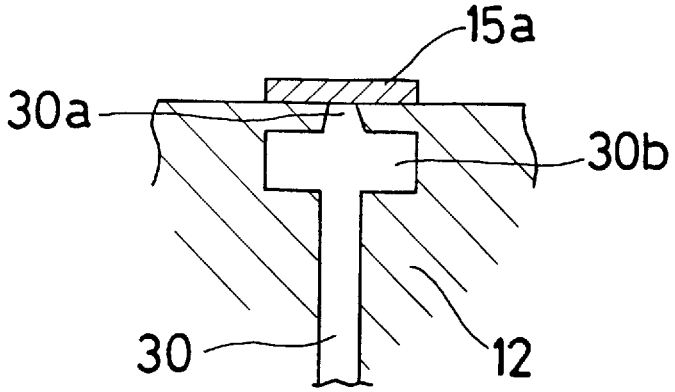
FIG. 12 is a detailed cross-sectional view taken on line B—B of FIG. 11.
Figure 13:
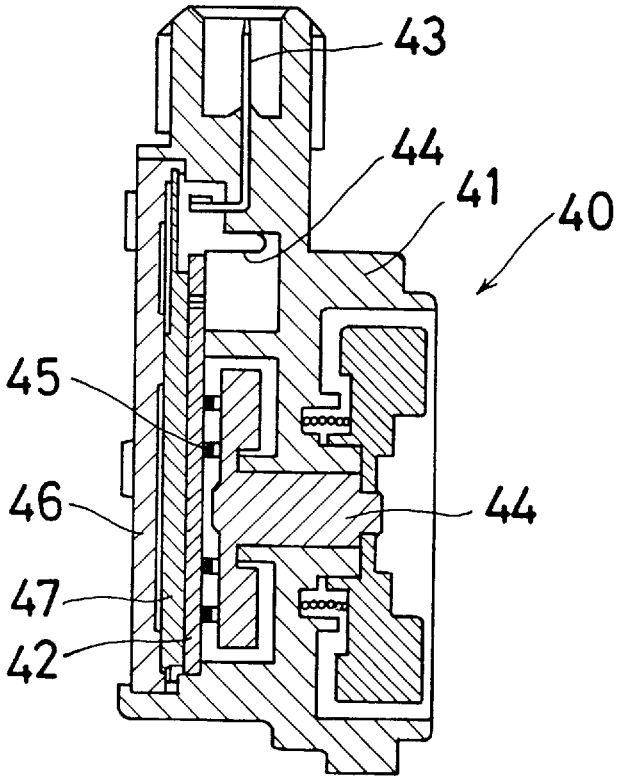
Fig. 13 PRIOR ART
FIG. 13 is a partial sectional view of a prior art variable resistor.

An eighth embodiment of a variable resistor according to the present invention is shown in FIGS. 11 and 12. The eighth embodiment is different only in the form of the three metallic terminals of first embodiment.

One end of the terminal 30 of the eighth embodiment is in the form of a cross made by pressing a plate so that the end 30*a* is formed with a small width and a wider portion 30*b* between the end 30*a* and the main terminal 30. The terminal 30 is secured in the second housing 12 by molding in resin as one body. In this way, the resin flows about the large width part 30*b* as shown in FIG. 12 so that the end portion of the terminal 30 is solidly fixed in the second housing 12. Whenever the thermal coefficient of expansion of the second housing 12 differs from that of the terminal 30, the distance between the electrode 15*a* and the large width part 30*b* is less subject to change during heating. Therefor, the electrode 15*a* is less apt to break.

In these embodiments, the electrodes and the ends of the terminals in each embodiment are integrally formed as one body, so that it is not necessary to solder any connections. Further, the number of parts of the variable resistor are less than the number of parts in a conventional variable resistor.

In the above embodiments, there are disclosed rotary sensors as variable resistors, but, the variable resistor can be of another type suitable for the detection of straight movement or any other movement.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed:

1. A variable resistor comprising:

a circuit board formed of a resin having at least one electrode and a resistance pattern comprised of thermosetting resin disposed on a surface thereof;

at least one metallic terminal having an end portion molded into the circuit board and disposed in contact with the electrode; and a brush slidably engaging the resistance pattern;

wherein said end portion of the terminal is provided with three right angle bends with a straight portion between two of said bends with said straight portion disposed in contact with said electrode to prevent relative movement between said resin and said terminal upon application of heat to said circuit board to harden said thermosetting resin.

2. A variable resistor comprising:

a circuit board formed of resin having at least one electrode and a resistance pattern comprised of thermosetting resin disposed on a surface thereof;

at least one metallic terminal having an end portion molded into the circuit board and disposed in contact with said electrode; and a brush slidably engaging the resistance pattern;

wherein said end portion disposed in contact with said electrode is provided with a hollow hemispherical portion depending therefrom and completely imbedded in the resin of the circuit board to prevent relative movement between said resin and said terminal upon application of heat to said circuit board to harden said thermosetting resin.

3. A variable resistor comprising:

a circuit board formed of resin having at least one electrode and a resistance pattern comprised of thermosetting resin disposed on a surface thereof;

at least one metallic terminal having an end portion molded into the circuit board and disposed in contact with the electrode; and a brush slidable engaging the resistance pattern;

wherein said end portion of the terminal is provided with a plurality of bends and straight portions of variable thickness with a central thin part disposed between two of said straight portions which are parallel to each other, said central thin portion being in contact with the electrode to prevent relative movement between said resin and said terminal upon application of heat to said circuit board to harden said thermosetting resin.

4. A variable resistor comprising:

a circuit board formed of resin having at least one electrode and a resistance pattern comprised of thermosetting resin disposed on a surface thereof;

at least one metallic terminal having an end portion molded into the circuit board and disposed in contact with the electrode; and a brush slidably engaging the resistance pattern;

wherein said end portion of the terminal is bent to form a comb having a plurality of parallel spaced apart projections disposed in contact with the electrode to prevent relative movement between said resin and said terminal upon application of heat to said circuit board to harden said thermosetting resin.

5. A variable resistor comprising:

a circuit board formed of resin having at least one electrode and a resistance pattern comprised of thermosetting resin disposed on a surface thereof;

at least one metallic terminal having an end portion molded into the circuit board and disposed in contact with the electrode; and a brush slidably engaging the resistance pattern;

wherein said end portion of the terminal has a J-shaped configuration having two spaced apart parallel portions and a transverse portion, said transverse portion being disposed in contact with said electrode to prevent relative movement between said resin and said terminal upon application of heat to said circuit board and said terminal to harden said thermosetting resin.

* * * * *